United States Patent [19]

Ryckman, Jr.

[11] 4,027,786

[45] June 7, 1977

[54] APPARATUS FOR HEATING DISPENSABLE FLOWABLE MATERIAL

[75] Inventor: William D. Ryckman, Jr., Asheboro, N.C.

[73] Assignee: General Electric Company, Bridgeport, Conn.

[22] Filed: Mar. 22, 1976

[21] Appl. No.: 669,305

[52] U.S. Cl. ..... 222/146 HA; 219/214; 219/303

[51] Int. Cl.[2] ..... H05B 1/02; B67D 5/62

[58] Field of Search ... 222/146 R, 146 HE, 146 HA; 219/296–305, 308, 327, 328, 214

[56] References Cited

UNITED STATES PATENTS

| | | | |
|---|---|---|---|
| 3,588,467 | 6/1971 | Grosjean | 222/146 HA |
| 3,733,460 | 5/1973 | Ryckman | 222/146 HA X |
| 3,749,880 | 7/1973 | Meeks | 222/146 HA X |
| 3,758,002 | 9/1973 | Doyle et al. | 222/146 HA |
| R27,304 | 3/1972 | Flowers | 222/146 HA |

*Primary Examiner*—Drayton E. Hoffman
*Assistant Examiner*—David A. Scherbel
*Attorney, Agent, or Firm*—John F. Cullen; George R. Powers; Leonard J. Platt

[57] ABSTRACT

Apparatus for heating flowable material from a pressurized container in a housing with a heat exchanger assembly having an inlet and outlet and passage conducting the material therebetween, and an electrically heated closed tube in heat transfer relation with the passage. In this general arrangement, an improvement is provided in the control for the electrically heated closed tube, that comprises a substantially flat non-conducting chassis with electric conductors through the chassis and sealed thereto; an adjustable thermostat is supported on one side of the chassis and connected to the conductors; an extending heat conducting closed tube in fluid tight seal with the chassis is provided on the other side thereof and it has a heating element therein. The passage is disposed around the tube in a tight helix for good heat transfer and a biased non-conducting axially and rotatably moveable control rod extends through the chassis and is sealed thereto. A cam on the rod connect it to the thermostat and the rod activates the thermostat on axial movement and adjusts it through the cam on rotary movement. On this control mechanism there is provided a non-conducting light transmitting cover hermetically sealed to the chassis to enclose the thermostat and all connections thereto including a signal light whereby the control elements are completely sealed against electrical and fluid leakage. A single control rod provides adjustment of the temperature of the dispensed material and acts as a turn-on switch.

5 Claims, 6 Drawing Figures

APPARATUS FOR HEATING DISPENSABLE FLOWABLE MATERIAL

BACKGROUND OF THE INVENTION

1. Field of the Invention

The invention relates to a control means as used in apparatus used to electrically heat flowable material dispensed from pressurized containers, such as shave cream.

2. Description of the Prior Art

Apparatus for heating shave cream dispensed from pressurized containers, has been known for some time. Conventional pressurized containers use a propellant gas to discharge foam products therefrom. Generally, the propellant gas is dispersed throughout the product under pressure in a liquified form and, upon actuation of the outlet valve, the propellant forces the product out of the container and, simultaneously, expands to form gas bubbles and thus generate the foam.

Expansion of the propellant from liquid to a gas, however, has a cooling effect on the foam product. This cooling is undesirable because cold shave cream foams are not only uncomfortable, but also slow in softening the beard. Hair is more easily shaved when softened by the penetration of moisture from the shave cream and the softening effect increases at higher cream temperature. Thus, numerous heating devices have been proposed for heating foam shave cream discharged from the containers to increase the ease and effectiveness of shaving. Some previously proposed devices employ electrical resistance elements or wires to supply the heat with a switch operable by the user to control the heating element. When a pressurized container is used it is important that it not be subjected to elevated temperatures which could cause it to burst. Many prior art dispensers do not automatically turn off and, while having a temperature responsive thermostat to denergize the heating element, some permit the thermostat to continuously recycle which can result in a build-up of temperature transferable to the pressurized container. Also, some prior art dispensers energize the heating element by pressing a button. Excessive temperature rise can occur if the actuation of the button is repeated in rapid succession or is held down to keep it depressed for a long period of time. A thermostatic switch has been designed to avoid these difficulties and is fully disclosed and claimed in patent 3,733,460 while the general arrangement of a heated shave cream dispenser is shown in patent 3,749,880 both of common assignment. The present invention is an improvement on said 3,733,460 patent in disclosing and claiming a combination with an improvement in the control means for heating the dispensed material.

SUMMARY OF THE INVENTION

In accordance with the invention, in an apparatus for heating flowable material such as shave cream from a pressurized container disposed in a housing with a heat exchanger assembly having an inlet and an outlet and passage means carrying the dispensed material therebetween, and an electric heating means in close heat transfer relation with the passage means, there is provided an improvement in the control means for the heating means comprising a substantially flat non-conducting plastic chassis with electric conductors extending through the chassis and sealed thereto. An adjustable thermostat of the general type of said 3,733,460 patent is provided and supported on one side of the chassis and connected to the conductors. An extending heat conducting closed tube is provided in fluid tight seal with the chassis on the other side from the thermostat which tube has heating means therein and the passage means is wound snugly around the tube in multiple turns for good heat transfer relation from the tube to the passage. A single biased non-conducting plastic control rod is provided extending through the chassis and sealed thereto and adapted to move both axially and rotatably. A cam means is provided, rotatable by the rod, and connecting to the thermostat to variably set the thermostat and the rod is thus able to activate the thermostat on axial movement and adjust it through the cam on rotation. A signal light may also be wired into the thermostat. To enclose all of these components on the one side of the chassis, a non-conducting preferably clear plastic cover is hermetically sealed to the chassis so the interior components are both electrically and fluid sealed. Thus, the main object of the invention is to provide a control means that hermetically seals the parts for safety in immersion and provides both adjustable material temperature selection and turn on with a single control rod. Turn off is automatic.

DESCRIPTION OF THE PREFERRED EMBODIMENT

The invention is described in connection with dispensers of shaving cream although it is applicable to any flowable material and reference is made to patent 3,733,460 of common assignment for a complete description of the thermostat as substantially used herein. The present invention is an improvement on the 3,733,460 patent in providing an improved control assembly.

Figure 1:
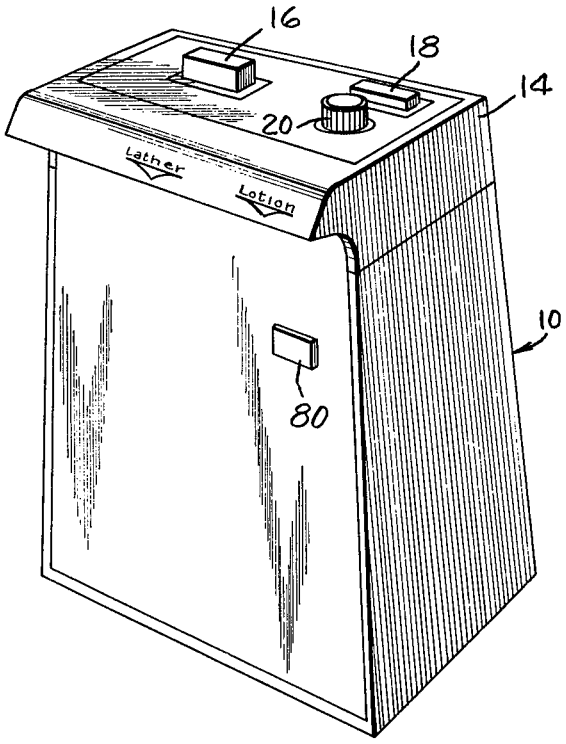
FIG. 1 is a perspective view of an electrically heated shave cream dispenser.
Figure 2:
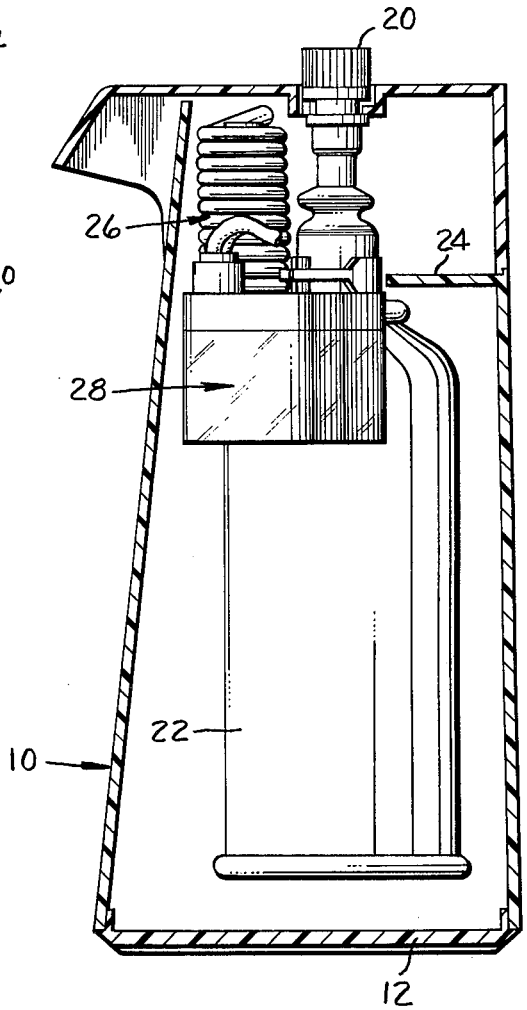
FIG. 2 is a partial cross-sectional view showing the interior of the housing and the control means.

Referring to FIG. 1 there is shown a heated shave cream dispenser having a plastic molded housing 10 and a base 12 detachable from the housing for replacement of a pressurized container. A cover 14 is semi-permanently attached to the housing from below in any suitable manner to enclose the working parts and provide a base for various indicia and controls such as lather dispenser button 16, lotion button 18, and thermostat button 20, which effects a temperature control of the lather. Cover 14 may overhang the front portion of housing 10 so the user's hand fits under the overhang to receive heated lather or shaving lotion as indicated in FIG. 1. To support the pressurized container 22 and operating components of the apparatus, the housing has an internal wall 24 that may be molded as part of the housing and suitably formed to assist in locating and centering any of the large number of leading brands of foam lather dispenser containers 22.

The rest of the internal operating structure consists of an adjacent heat exchanger assembly 26 operated by an adjustable thermostat control means 28 as set by the thermostat button 20.

The specific thermostat means and lotion dispensing structure form no part of the present invention except as they fit in the overall package of FIG. 1 with the heat exchanger assembly 26 remotely located from container 22 — a desirable feature as will be apparent — and this combination is generally shown in said patent 3,733,460.

In accordance with the present invention, an improvement is provided in the control means for the heat exchanger, including the heat exchanger assembly and the actuating means. There is also provided a control rod that both turns the unit on and also sets the temperature desired for the heated shave cream. The entire control is arranged in a more efficient and compact package that is both electrically and fluidically sealed by enclosing the thermostat and all connections thereto in a hermetically sealed case.

Figure 3:
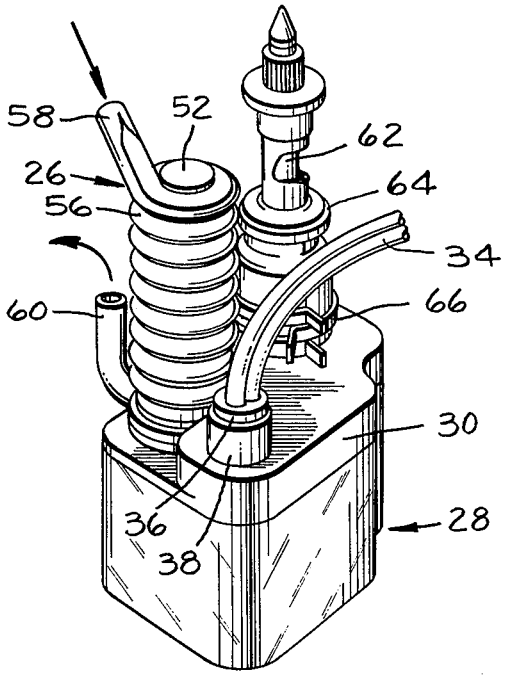
FIG. 3 is a perspective view of the control means.
Figure 4:
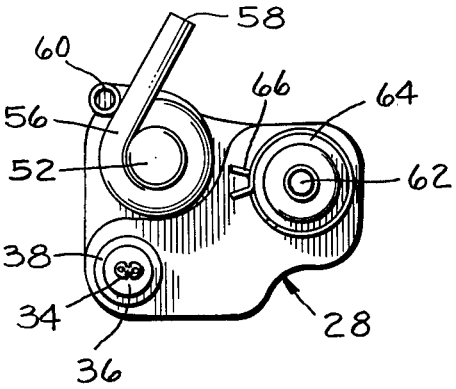
FIG. 4 is a top view looking down on FIG. 3.
Figure 5:
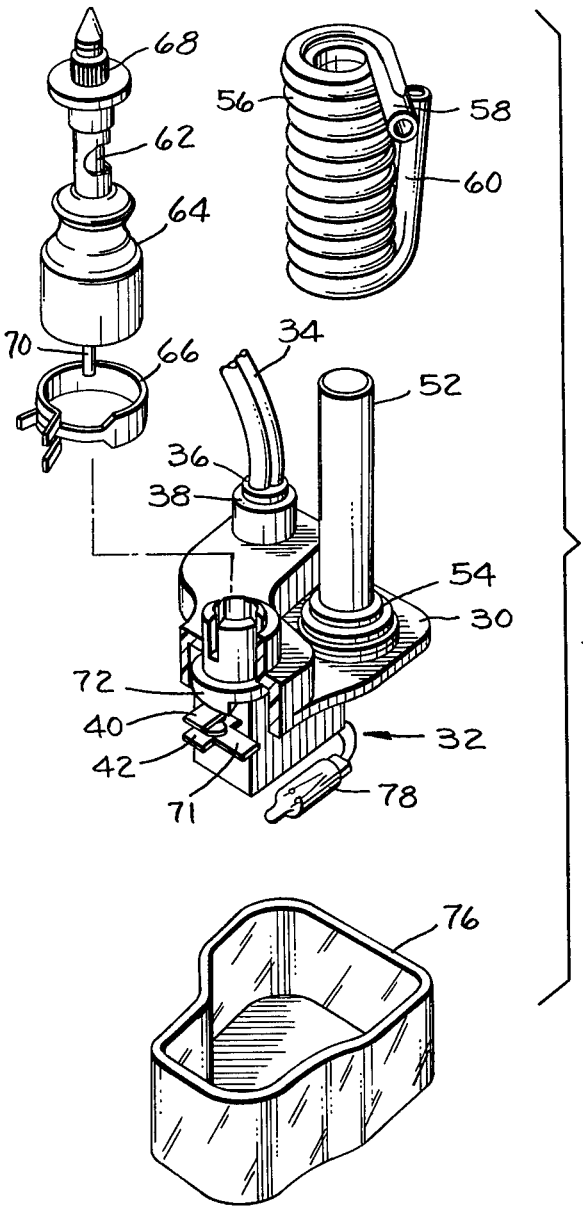
FIG. 5 is an exploded partially broken perspective view of the control means shown in FIG. 3.

To this end, there is provided a single base on which all the parts are mounted, the base being a substantially flat non-conducting chassis 30 of a suitable plastic such as a glass filled Lexan polycarbonate or equivalent as shown in FIGS. 3 and 5. The chassis is used as the main supporting member for an adjustable thermostat-generally indicated as 32 — that is supported on one side — in this case the bottom — of the chassis. Electric current is supplied to the thermostat by conductors 34 that extend through the chassis from the opposite side and are cemented into place at 36 in formed portion 38 of the chassis to provide a fluid tight seal.

Figure 6:
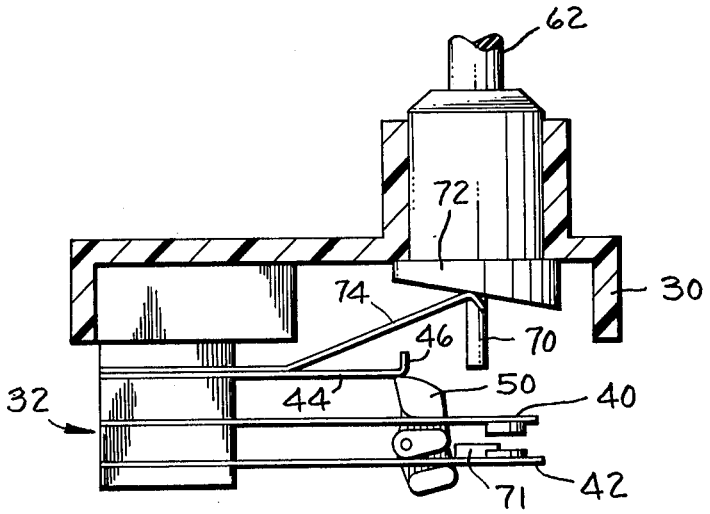
FIG. 6 is a partial sectional view of the thermostat showing control rod actuation thereof.

It should be ntoed that the details of the thermostat are substantially the same as shown in patent 3,733,460 so are only generally indicated in FIG. 6 herein. Thus, the thermostate includes a pair of contact blades 40 and 42, a bimetal 44 having an upturned end 46 and a rocking cam element 50 acting on all three components in much the manner disclosed in said 3,733,460 patent and more generally described later. In order to reduce the size of and improve the heat exchanger conduction, a short extending heat conducting closed tube 52 is provided on the opposite side of chassis 30 and this tube is a substantially hollow metal tube such as aluminum closed at its upper end and flud sealed at 54 to the chassis. Disposed within the tube is any common electric heating means of suitable form. The heat exchanger assembly includes a passage means in the form of tightly wound multiple turn coiled member 56 with inlet 58 to receive foam from the pressurized container and outlet 60 directing the heated foam to the lather outlet at the front of housing 10. This arrangement of passage means 56 disposed on tube 52 permits the tube and passage to be in close or snug good heat transfer relation with one another. This provides a more efficient and smaller heat exchanger since the passage means is directly supported on heated closed tube 52 to directly receive all the heat therefrom.

Thus, the single chassis 30 contains the full heat exchanger 52–60 on one side and the controlling thermostat 32 on the other side with the parts passing through the chassis fluid sealed thereto. In order to control the thermostat, a single, upwardly biased preferably non-conducting plastic control rod 62 is provided and it also extends through the chassis and is sealed thereto by flexible boot 64 and clamp 66. The control rod 62 is biased upward by boot 64 as well as by an internal spring not shown. The top of the rod may be splined at 68 to receive thermostate button 20. The single sealed rod is designed to provide dual functions and to move both axially through chassis 30 and rotate therein. The axial motion of the rod is utilized by projection 70 on the bottom thereof and the rotatable motion is utilized by a cam 72, both of which are connected to act on the thermostat as will now be explained.

The general thermostatic operation is specifically described in said '460 patent and not repeated here. FIG. 6 shows the device in the off position. In order to actuate the thermostat, control rod 62 is depressed whereupon projection 70 contacts the side arm 71 (FIG. 5) of contact blade 42 pushing it down. As it goes down, it rotates cam element 50 clockwise permitting bimetal 44 to drop and be jammed behind the cam by upturned end 46. When the control rod 62 is released, contact blade 42 goes up closing against contact blade 40 and activating the thermostat and electric curent flows to heat the foam. Note that holding button 52 down in an attempt to hurry the device or try to overheat will not allow the device to go on since it is activated only when button 22 is released and control rod 62 rises permitting contact blade 42 to rise and close against adjacent blade 40. As the heating continues, bimetal 42 heats and end 46 rises freeing cam 50 to rotate counterclockwise under the upward bias of blade 40, and open the contacts on blades 40 and 42 shutting off the current automatically. This generally is the operation of the thermostat so that it will be apparent that depressing and releasing the rod provides the turn-on of the device. In addition, the control rod can be rotated to change the thermostat setting and thus the temperature of the dispensed foam. To this end, an additional arm 74 is provided and connected to bear on the bimetal and ride on cam 72 as shown in FIG. 6. Thus, rotation to bring arm 74 against the high portion of cam 72 puts maximum force on bimetal 44 and requires a higher heat to bend it upward to release the upturned end 46 and operate as previously explained. So, a single control provides both turn-on and adjustable material temperature with no possibility of forcing overheating by holding or pulsing button 22. Thus, as in the said 3,733,460 patent, any overheating of the container is positively prevented in this combination by the use of a similar one-shot manual reclosing thermostat as described.

To complete the control mechanism so it is both electrically and fluid sealed in the event the entire lather dispenser falls into water, a cover 76 of clear polycarbonate or similar material is hermetically sealed to the chassis by ultrasonically welding it in place. This forms a waterproof container for all of the electrical parts and encloses the thermostat and all connections thereto. To complete the assembly, a suitable indicator light 78 may be wired into the thermostat and it is also enclosed by cover 76. So that the light is visible to the operator through window 80, cover 76 is a clear or translucent polycarbonate or similar material. Thus, the signal light indicates an "on" condition of the apparatus.

The apparatus described performs the same basic functions as that disclosed in said 3,733,460 patent of heating and dispensing but in addition provides adjustable lather temperature and direct mechanical turn-on with a single knob, a hermetically sealed plastic control case, an indicator lamp sealed inside the case, and a much improved heat exchanger all in a single lightweight control assembly that is safely immersible in the event the dispenser falls in a basin of water.

While there has been shown heretofore a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. Apparatus for heating flowable material from a pressurized container in a housing with a heat exchanger assembly having an inlet and outlet and passage means conducting the material therebetween, and electric heating means in heat transfer relation with said passage means, the improvement in control means for said heating means comprising, a substantially flat non-conducting chassis, electric conductors through said chassis and sealed thereto, an adjustable thermostat supported on one side of said chassis and connected to said conductors, an extending heat conducting closed tube in fluid tight seal with said chassis on the other side thereof and having said heating means therein, said passage means disposed around said tube for said heat transfer relation, a biased axially and rotatably movable control rod extending through said chassis and sealed thereto, cam means rotatable by said rod connecting to said thermostat, said rod disposed to activate the thermostat on axial movement and adjust it through said cam on rotation, and a non-conducting cover hermetically sealed to said chassis enclosing the thermostat and all connections thereto, whereby said electrically and fluidically sealed control means provides both adjustable material temperature selection and turn-on with a single control rod.

2. Apparatus as described in claim 1 wherein said thermostat is of the one shot manual reclosing type.

3. Apparatus as described in claim 1 wherein said passage means is snugly wound around said heat conducting tube in multiple turns for direct heat transfer therebetween.

4. Apparatus as described in claim 3 wherein said chassis and cover are plastic and at least said cover is translucent.

5. Apparatus as described in claim 4 wherein a signal light is connected and disposed within said translucent cover and hermetically sealed therein to signal and "on" condition of said apparatus.

* * * * *